United States Patent [19]

McDonald et al.

[11] Patent Number: 4,870,233

[45] Date of Patent: Sep. 26, 1989

[54] METAL TRAY AND SUSCEPTOR COMBINATION FOR USE IN MICROWAVE OVENS

[75] Inventors: Duane L. McDonald, Minneapolis; Lynn H. Brown, Chanhassen, both of Minn.

[73] Assignee: General Mills, Inc., Minneapolis, Minn.

[21] Appl. No.: 245,620

[22] Filed: Sep. 19, 1988

[51] Int. Cl.[4] ..... H05B 6/80

[52] U.S. Cl. ..... 219/10.55 E; 219/10.55 F; 99/DIG. 14; 426/241; 426/243; 426/107

[58] Field of Search ..... 219/10.55 E, 10.55 F, 219/10.55 R; 426/106, 107, 109, 112, 113, 234, 241, 242, 243; 126/390; 99/DIG. 14; 206/45.12, 45.2, 45.21, 622, 605, 591, 593, 594; 220/450, 458, 468

[56] References Cited

U.S. PATENT DOCUMENTS

| | | | |
|---|---|---|---|
| 4,558,198 | 12/1985 | Levendusky | 219/10.55 E |
| 4,594,492 | 6/1986 | Maroszek | 219/10.55 E |
| 4,661,671 | 4/1987 | Maroszek | 219/10.55 E |
| 4,661,672 | 4/1987 | Nakenaga | 219/10.55 E |
| 4,703,148 | 10/1987 | Mikulski | 219/10.55 E |
| 4,777,053 | 10/1988 | Tobelmann | 426/107 |

*Primary Examiner*—A. D. Pellinen
*Assistant Examiner*—Leon K. Fuller
*Attorney, Agent, or Firm*—L. MeRoy Lillehaugen; John A. O'Toole

[57] ABSTRACT

A metal tray has its inner and outer surfaces coated with a plastic material. Within the tray is a first susceptor unit which includes a layer of corrugated paperboard composed of A-flutes secured to the underside of a substrate having a metallized foil secured to its upper side. A food item to be heated is supported on the first susceptor unit. A second susceptor unit overlies the food item, the second susceptor unit having a downturned flange inserted between one side of the tray and one side of the food item.

13 Claims, 3 Drawing Sheets

METAL TRAY AND SUSCEPTOR COMBINATION FOR USE IN MICROWAVE OVENS

BACKGROUND OF THE INVENTION

1. Field of the Invention

This invention relates generally to the microwave heating of various food products, such as fish fillets, and pertains more particularly to the combination of a disposable metal tray and means for browning and crisping the food product contained therein.

2. Description of the Prior Art

Various packaging arrangements have been devised with the thought in mind that the food product to be heated in a microwave oven should be browned and crispened, both to enhance its taste and also to improve its appearance. Therefore, it is not surprising that a number of patents have been granted, the patents disclosing reusable utensils with various types of coatings that promote the browning and crisping.

Likewise, patents have been granted where the container is to be discarded after it has been used just once. Of the patents that have been granted in this latter group, it is believed that U.S. Patent No. 4,703,148 issued on Oct. 27, 1987 to Barry S. Mikulski et al for "Package for Frozen Foods for Microwave Heating" constitutes the closest known prior art arrangement, the patent having been assigned to the same assignee as this patent application.

While the package disclosed in said patent has served its purpose well, the disadvantage is that the procedure for packaging the frozen food is more complicated than generally desired. Furthermore, the patented package is somewhat more costly to fabricate. Hence, a need still exists for an extremely simple type of package that will provide the necessary type of heat for both browning and crisping the product to be microwave heated.

SUMMARY OF THE INVENTION

Accordingly, one important object of the present invention is to provide a disposable plastic-coated metal tray in which the contents, such as fish fillets or fish sticks, can be conveniently and efficiently browned and crispened when subjected to microwave heating energy. In this regard, an aim of the invention is to provide two susceptor units, one below the product and one above the product, which together with the coated tray, effectively make use of the heat that is generated so that a better browning and crisping of the food are achieved.

Another object of the invention is to provide a packaging arrangement that can be readily placed in a microwave oven after it has been removed from its cardboard carton. In this regard, one need only remove the tray and its contents from the outer carton and without further manipulation or effort place the tray and its contents in a microwave oven. After the heating has been completed, the invention enables the user to serve the food without having to remove any wrapping material, it only being necessary to remove the upper susceptor unit which is only resting loosely on the food.

The invention has for still another object the effective drainage of any oils that may be released from the food product during the cooking thereof, and also the release of any vapors that may have been generated during the heating procedure.

Another object is to provide a coated metal tray and two susceptor units that may be separately stacked and stored until they are to be assembled with the food product.

A further object is to provide a disposable metallic tray and susceptible combination susceptible to being heated with microwave energy that will be relatively inexpensive to produce and which is easy to assemble on a production-line basis.

Briefly, our invention contemplates a metal tray coated with an appropriate plastic material so as to minimize arcing and at the same time improve the reflection of the microwave energy with respect to the food item being heated. A first susceptor unit is placed directly on the bottom of the tray, the unit including a metallized film having a layer of corrugated paperboard secured to its underside. The food product to be heated is placed on the metallized film. A second susceptor unit having a downturned flange is placed on top of the food product. More specifically, the second or upper susceptor unit includes a metalized film that contacts the food product, the upper face of the film having a paperboard layer integrally attached thereto. A number of perforations in the lower susceptor unit permit oil to drain down into the voids created by the corrugated or fluted configuration of the underside of the lower unit. A number of slits in the upper susceptor unit permit the upward escape of vapors.

DESCRIPTION OF THE PREFERRED EMBODIMENT

Figure 1:
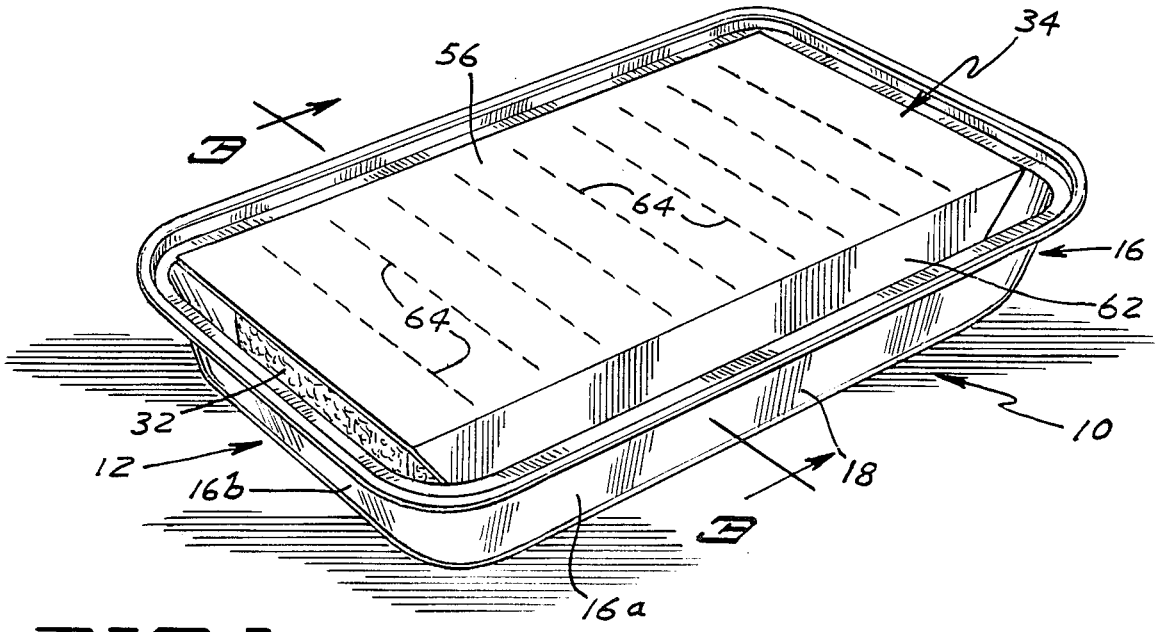
FIG. 1 is a perspective view of our assembled package ready to be placed in a microwave oven.

Referring now to the drawings, the package combination exemplifying our invention in FIG. 1 has been denoted generally by the reference numeral 10. The assmebled package 10 includes a metal tray 12 having a bottom wall 14 and a continuous peripherally disposed side wall 16 comprised of sections **16*a*, 16*b*, 16*c* and 16*d*. There is a plastic coating 18 on the outer surface of the tray 12 and a plastic coating 20 on its inner surface; thus, the tray 12, which is of aluminum, is completely covered by the outer and inner plastic coatings 18, 20. The use of such a coated tray 12 minimizes arcing within the oven, as well as eliminating the possibility that the tray 12 will ignite and burn. The tray 12** is more fully described in U.S Pat. No. 4,558,198 issued on Dec. 10, 1985 to Thomas L. Levendusky et al for "Metal Container System for Use in Microwave Ovens."

The package container 10 comprises a lower susceptor unit 30 on which are supported two fish fillets 32 in the illustrated instance, the fillets 32 constituting the product to be microwaved, and an upper susceptor unit 34 which covers or overlies the two fish fillets 32.

The lower susceptor unit 30 includes a metallized film 36 having a paperboard lamination or substrate 38 secured to its underside. The susceptor unit 30 additionally includes a layer of corrugated paperboard 40 having a plurality of parallel flutes 42, the crest of which are glued to the layer of paperboard 38. In this way, the flutes 42 form a plurality of upper and lower parallel voids or passages 44 and 45, respectively. Stated somewhat differently, the lamination or substrate 38 forms one face of the corrugated structure. A series of perforations 46 are formed in the unit 30, the perforations 46 extending downwardly thorugh the metallized film 36 and the underlying paperboard substrate 38. In this way, any oil that is released from the fish fillets 32 can drain downwardly through the perforations 46 into the voids 44 formed by the flutes 42.

The height of the flute 42 is extremely important in that an increased height greatly enhances the amount of heat provided by the susceptor unit 30. An optimum heating is achieved when the corrugated paperboard 40 is fabricated with so-called A-flutes which have a height on the order of 3/16 inch. A B-flute having approximately 3/32 inch height is less effective and a C-flute having an approximate height of 9/64 inch even less effective, whereas an E-flute having an approximate height of 3/64 inch proved unsatisfactory. A flat susceptor did not produce sufficient heat to achieve the desired crisping and browning effect.

Hence, it will be appreciated that the flutes 42 perform a dual functionin that (1) the passages 44 by reason of the perforations 46 accommodate whatever oil drains thereinto from the fillets 32, and (2) the raised height of the metallized film 36 with respect to the bottom wall allows microwave energy to be optimumly reflected upwardly.

It should be appreciated from what has been described with respect to the lower susceptor unit 30 that it constitutes an individual unit that can be readily inserted into the tray 12, not being secured to any portion of the tray 12. Consequently, when the tray 12 is moving along the conveyor belt of an assembly line, the packaging machinery need only deposit a unit 30 into the tray 12 at one station. It is at a second station that the fish fillets 32 are placed in the tray 12, more specifically, on the upper side of the susceptor unit 30. It will be appreciated, however, that it is the metallized film 36 that converts some of the microwave energy into usable thermal energy that will brown and crispen the fish fillet 32.

Figure 2:
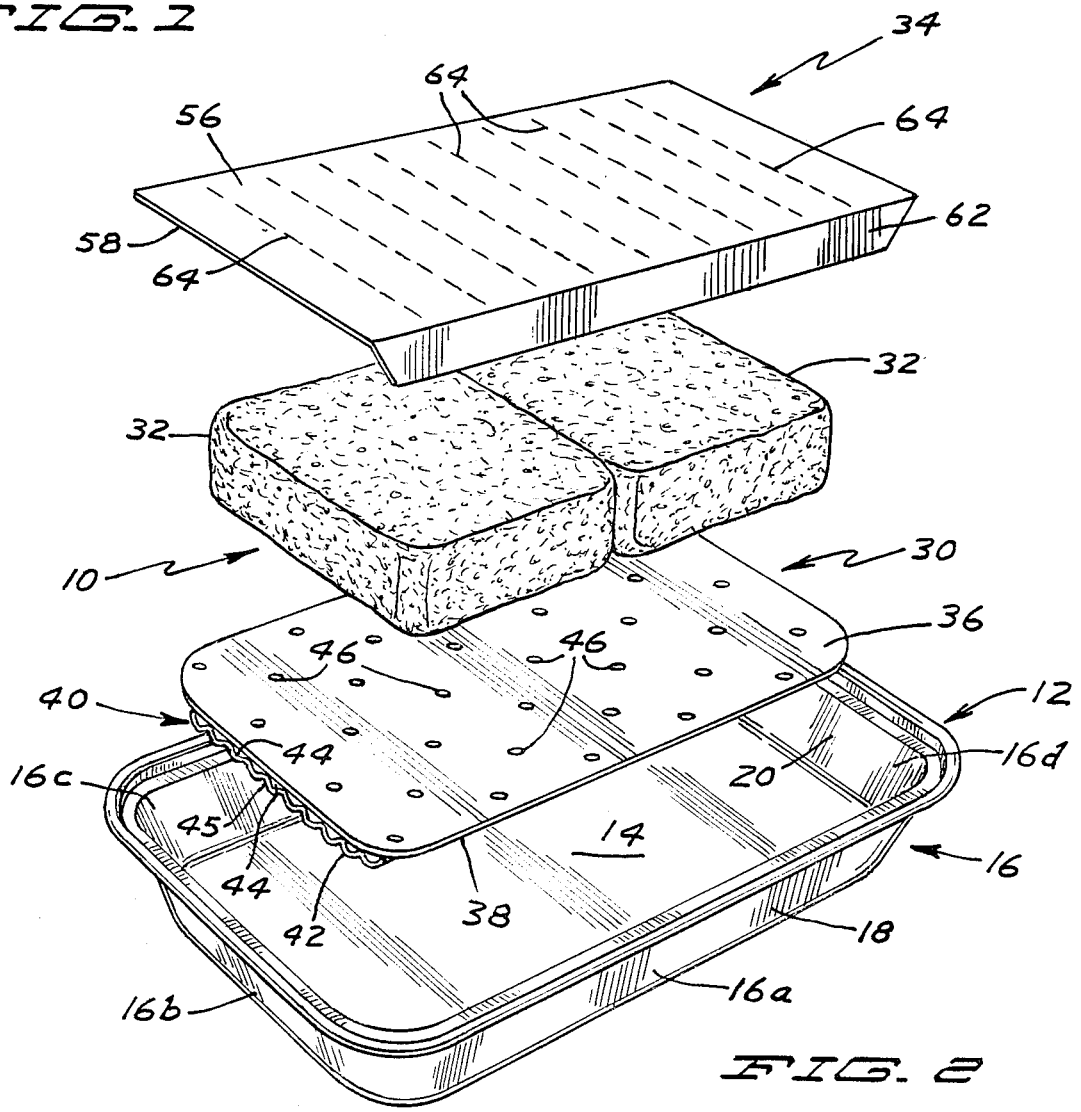
FIG. 2 is an exploded perspective view of the package components, the view being taken in the same direction as FIG. 1.
Figure 3:
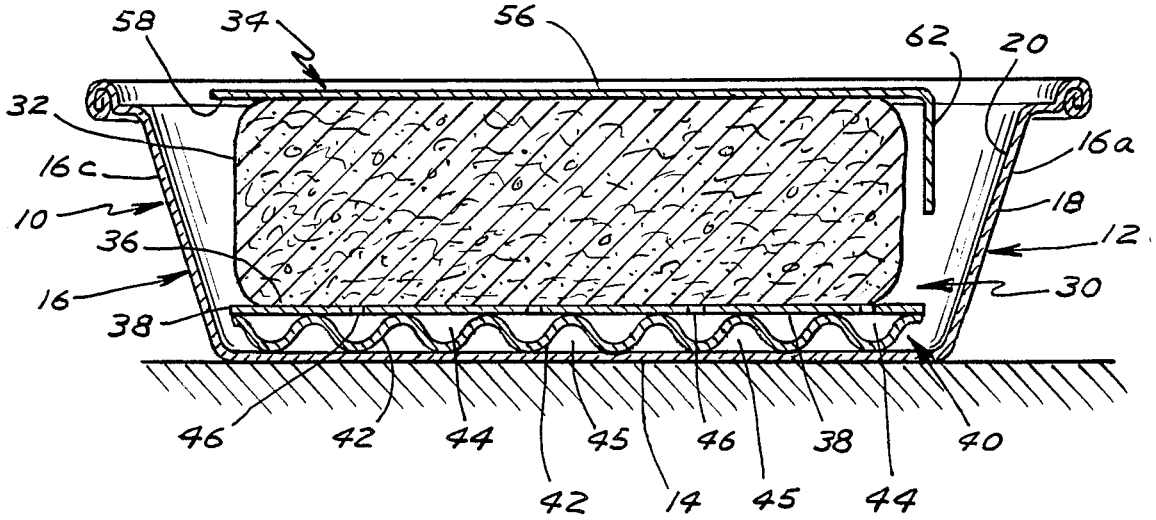
FIG. 3 is a transverse sectional view taken in the direction of line 3—3 of FIG. 1.
Figure 4:
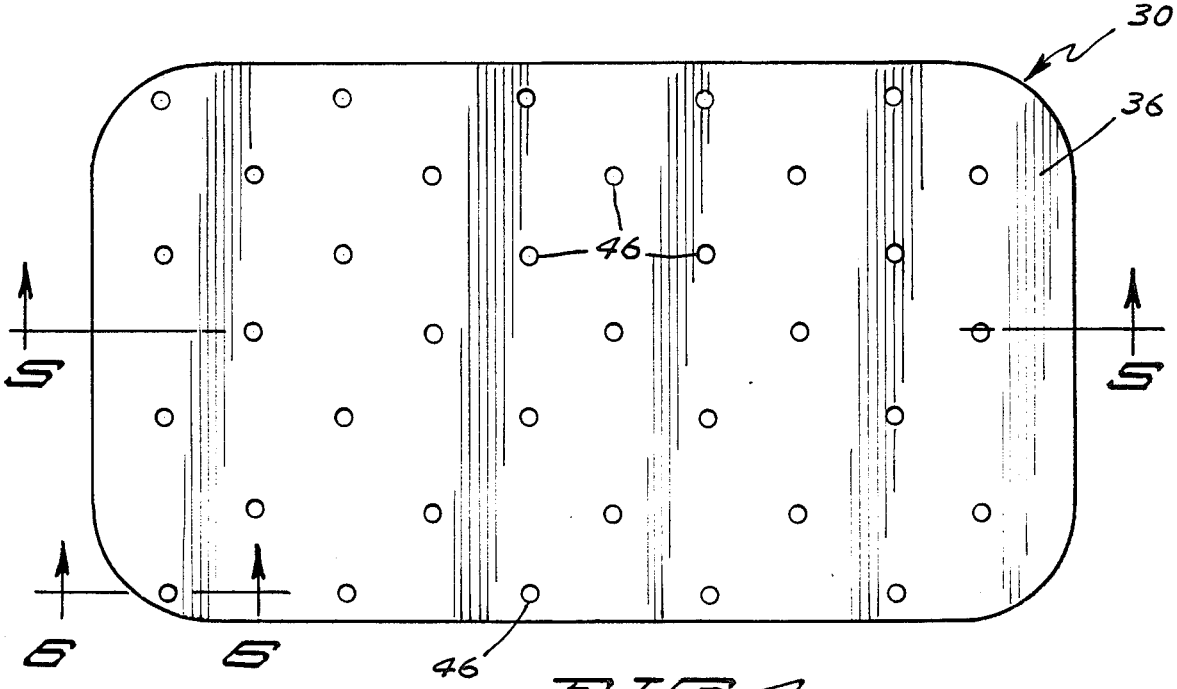
FIG. 4 is a top plan view of the lower susceptor unit.
Figure 5:
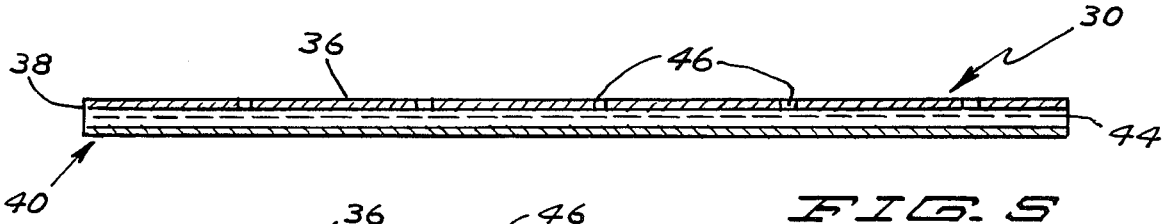
FIG. 5 is a longitudinal sectional view taken in the direction of line 5—5 of FIG. 4.
Figure 6:
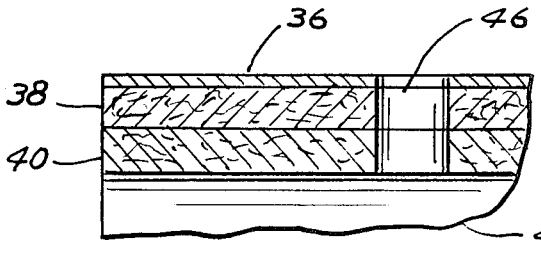
FIG. 6 is a greatly enlarged sectional detail taken in the direction of line 6—6 in FIG. 4.
Figure 7:
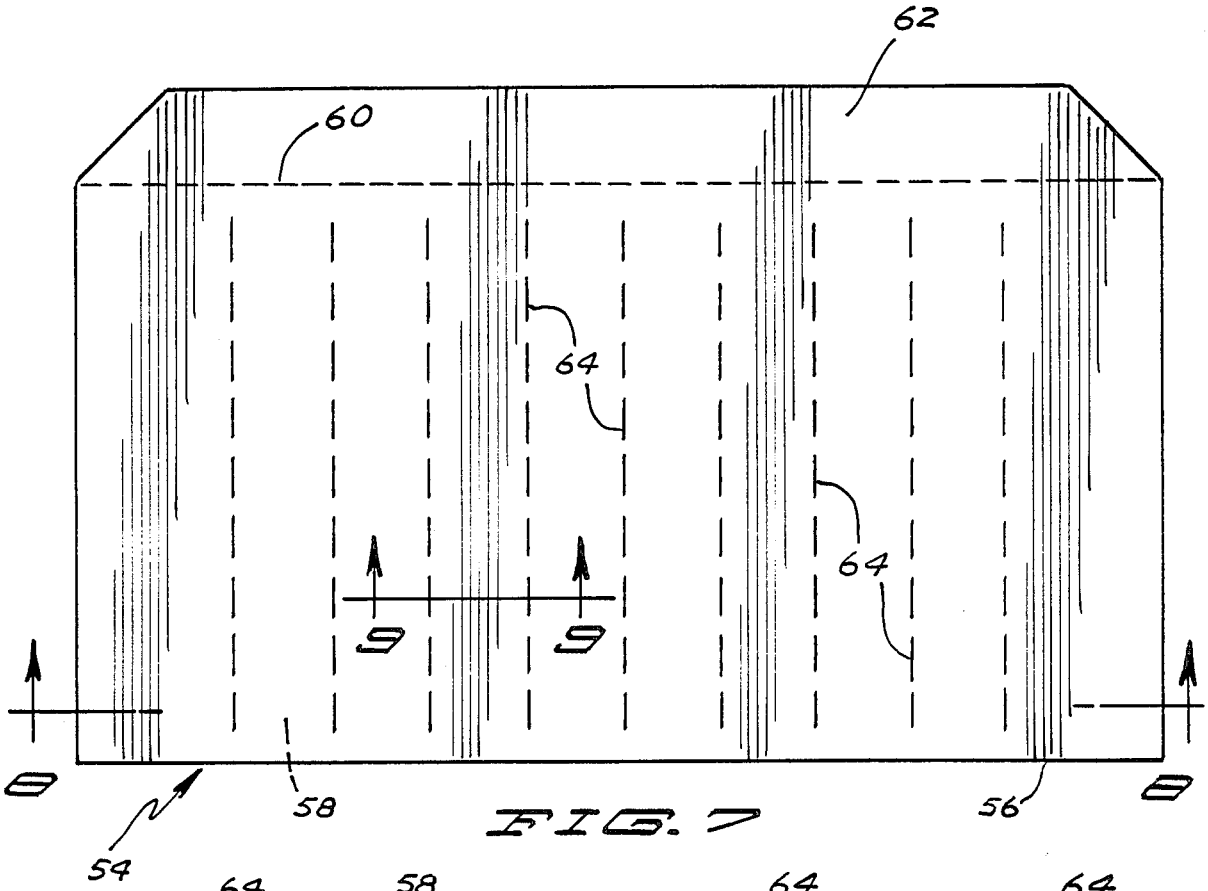
FIG. 7 is a top plan view of the blank from which the upper susceptor unit is formed.
Figure 8:
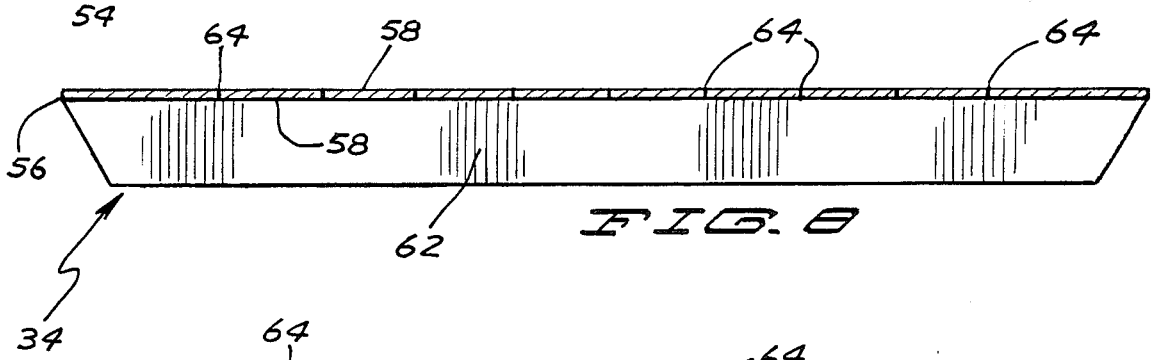
FIG. 8 is a longitudinal sectional view taken in the direction of line 8—8 of FIG. 7 but showing the susceptor flange bent down in preparation for insertion into a tray.
Figure 9:
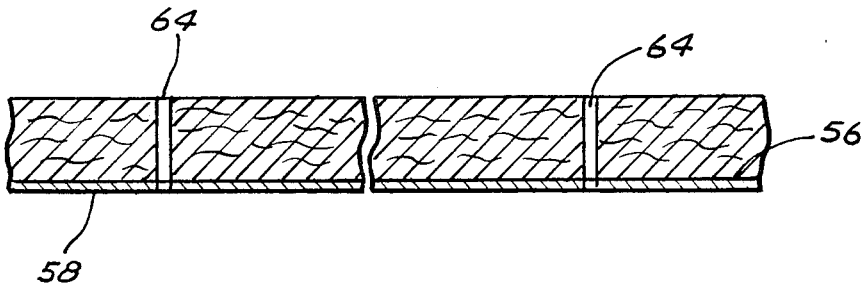
FIG. 9 is a greatly enlarged sectional detail taken in the direction of line 9—9 in FIG. 7.

Attention is now directed to the construction of the upper susceptor unit 34. The unit 34 is fabricated from a flat blank indicated generally by the reference numeral 54; see FIG. 7. The blank 54 includes a paperboard panel 56 and a metallized film 58. In other words, the film 58 is secured to and underlies the dielectric layer 56 of paperboard. By means of a series of longitudinally extending slits 60, a weakened fold line is provided. This fold line 60 enables a flange 62 to be downturned readily about the slits 60 which form the weakened fold line so that the flange 62 can assume a perpendicular relationship as can be seen from FIGS. 2, 3 and 8. Additional slits 64 are arranged in transversely extending rows. In this way, any steam or vapors are readily vented upwardly through the slits 64. However, it should be appreciated that some of the microwave energy impinging on the upper unit 34 is immediately converted to thermal energy, thereby producing a browning and crispening of the fish fillets 32.

The flange 62 performs a very important function in that it facilitates the emplacement of the unit 34 on top of the fish fillets 32 inasmuch as the flange 62 can be readily inserted between the fillets 32 in the section 16a of the side wall 16. It should also be recognized that the ends of the flange 62 prevent any unwanted longitudinal shifting of the upper susceptor unit 34, for any appreciable movement of the flange 62 abuts the sections **16*b* and 16*d* of the side wall 16**.

The coated metal tray provided shielding of a substantial amount of the microwave energy produced in the oven. The design of the tray 12 permits microwave energy to enter only through the top thereof. Some of the microwave energy which reflects from the inner surface of the tray 12 is absorbed by susceptors 30 and 34, thus causing them to become hot, so as to heat the surface of the fish fillets 32. Some of the microwave energy, it should be understood, enters the fish fillets 32, thus causing the fish to be heated and baked. In this way, the fish fillets 32 are not over exposed to the microwave energy, and the fillets remain moist while their surface is being browned or crispened.

From the foregoing, it should be recognized that a sufficient amount of microwave energy is converted into thermal energy by reason of the metallized films 36 and 58 so as to effectively and efficiently brown and crispen the fish fillets 32. At the same time, any steam or vapors emanating from the fillets 32 can escape upwardly through the slits 64. Consequently, the perforations 46 and the slits 64 prevent the fillets 32 from becoming soggy because the moisture is drained downwardly in one instance through the perforations 46 and any moisture in the form of vapor or steam is vented upwardly through the slits 64.

We claim:

1. A package combination for use in a microwave oven comprising a metal tray including a bottom wall and a continuous side wall extending upwardly from said bottom wall and forming an open top, the inner and outer surfaces of said walls having a plastic coating thereon, a first susceptor unit including a metallized film, a dielectric substrate integral with said film and a layer of corrugated dielectric material secured to the underside of said substrate, said first susceptor unit being loosely received in said tray with said corrugated layer engaging said bottom wall so as to locate said metallized film in a raised or spaced relation with respect to said bottom wall, a foot item on said first susceptor unit, and a second susceptor unit generally closing said open top and loosely overlying a substantial portion of the food item including a metallized film and a layer of dielectric material thereabove, said second susceptor unit constituting the sole means overlying said food item so that microwave energy is permitted to enter said metal tray only through its said open top and said second susceptor unit.

2. A package combination in accordance with claim 1 in which said corrugated dielectric material is composed of A-flutes.

3. A package combination in accordance with claim 1 in which said second susceptor unit includes a downturned means disposed between said food item and a section of said side wall.

4. A package combination for use in a microwave oven comprising a metal tray including a bottom wall and a continuous side wall extending upwardly from said bottom wall, the inner and outer surfaces of said walls having a plastic coating thereon, a first susceptor unit including a metallized film, a dielectric substrate integral with said film and a layer of corrugated dielectric material secured to the underside of said substrate, said first susceptor unit being loosely received in said tray with said corrugated layer engaging said bottom wall so as to locate said metallized film in a raised or spaced relation with respect to said bottom wall, a food item on said first susceptor unit, and a second susceptor unit loosely overlying a substantial portion of the food item including a metallized film and a layer of dielectric material thereabove, said second susceptor unit including a downturned flange disposed between said food item and a section of said side wall.

5. A package combination in accordance with claim 4 in which said flange also includes a portion of said metallized film.

6. A package combination in accordance with claim 5 in which said flange is formed by a weakened fold line.

7. A package combination in accordance with claim 6 in which said second susceptor unit has a plurality of slits formed therein.

8. A package combination in accordance with claim 7 in which said first susceptor unit includes a plurality of perforations formed therein so that any oils can drain downwardly into the voids formed by the flutes of said corrugated layer.

9. A package combination comprising a metal tray having its inner and outer surfaces covered with a plastic coating, a first susceptor unit in said tray including a metallized film and a layer of corrugated dielectric material secured therebeneath, at least one food item to be heated supported on the metallized film of said first susceptor unit, and a second susceptor unit overlying said food item including a metallized film and a layer of dielectric material secured thereabove, said second susceptor unit having a downward flange inserted between one side of said tray and one side of said food item.

10. A package combination in accordance with claim 9 in which said flange includes a continuation of said metallized film and said layer of dielectric material.

11. A package combination in accordance with claim 10 in which said metal tray includes a bottom wall and a continuous side wall, said flange having a width approximately one-half the height of said side wall.

12. A package combination in accordance with claim 11 in which said corrugated dielectric material raises said metallized film approximately 3/16 inch above said bottom wall.

13. A package combination in accordance with claim 12 in which said corrugated dielectric material is composed of A-flutes to raise said metallized film said approximately 3/16 inch to above said bottom wall.

* * * * *

UNITED STATES PATENT AND TRADEMARK OFFICE

CERTIFICATE OF CORRECTION

PATENT NO. : 4,870,233

DATED : Sept. 26, 1989

INVENTOR(S) : Duane L. McDonald & Lynn H. Brown

It is certified that error appears in the above-identified patent and that said Letters Patent is hereby corrected as shown below:

On the title page, item [56]:
In the Cited Refs.; "Nakenaga" should be -- Nakanaga --.

Col. 2, line 4; "susceptible" (first occurrence) should be -- susceptor --,
line 56; "assmebled" should be -- assembled.

Col. 3, line 1; "container" should be -- combination --,
line 17; "thorugh" should be -- through --,
line 35; "functionin" should be -- function in --.

Col. 4, line 15; "provided" should be -- provides --,
line 53; "foot" should be -- food --.

Col. 6, line 28; "inch to above" should be -- inch above --.

Signed and Sealed this

Twenty-first Day of August, 1990

*Attest:*

HARRY F. MANBECK, JR.

*Attesting Officer*

*Commissioner of Patents and Trademarks*